US005308823A

United States Patent [19]

Hotta et al.

[11] Patent Number: 5,308,823

[45] Date of Patent: May 3, 1994

[54] REVERSIBLE THERMOSENSITIVE RECORDING MATERIALS

[75] Inventors: Yoshihiko Hotta, Numazu; Keishi Kubo, Yokohama, both of Japan

[73] Assignee: Ricoh Co., Ltd., Tokyo, Japan

[21] Appl. No.: 850,553

[22] Filed: Mar. 13, 1992

Related U.S. Application Data

[60] Division of Ser. No. 595,244, Oct. 10, 1990, Pat. No. 5,116,803, which is a division of Ser. No. 361,801, May 30, 1989, Pat. No. 4,977,030, which is a continuation of Ser. No. 80,432, Jul. 30, 1987, abandoned.

[30] Foreign Application Priority Data

| | | | |
|---|---|---|---|
| Aug. 5, 1986 | [JP] | Japan | 61-182667 |
| Oct. 22, 1986 | [JP] | Japan | 61-251234 |
| Oct. 23, 1986 | [JP] | Japan | 61-253095 |
| Nov. 21, 1986 | [JP] | Japan | 61-278102 |
| Jan. 20, 1987 | [JP] | Japan | 62-9077 |
| Jan. 21, 1987 | [JP] | Japan | 62-12971 |

[51] Int. Cl.[5] ..... B41M 5/26

[52] U.S. Cl. ..... 503/209; 503/201; 503/217; 503/225

[58] Field of Search ..... 503/201, 217, 225, 208, 503/209

[56] References Cited

U.S. PATENT DOCUMENTS 4,695,528 9/1987 Dabisch et al. ..... 430/348

*Primary Examiner*—Pamela R. Schwartz

*Attorney, Agent, or Firm*—Flynn, Thiel, Boutell & Tanis

[57] ABSTRACT

A reversible thermosensitive recording material is made up of a substrate having a thermosensitive layer consisting essentially of a resin matrix and an organic low molecular substance dispersed in this resin matrix and is arranged to change its transparency reversibly depending upon the temperature. This thermosensitive layer further contains at least one additive.

11 Claims, 1 Drawing Sheet

REVERSIBLE THERMOSENSITIVE RECORDING MATERIALS

This is a division of Ser. No. 07/595,244, filed Oct. 10, 1990, now U.S. Pat. No. 5,116,803, which is a division of Ser. No. 07/361,801, filed May 30, 1989, now U.S. Pat. No. 4,977,030, issued Dec. 11, 1990, which is a continuation of Ser. No. 07/080,432, filed Jul. 30, 1987, now abandoned.

BACKGROUND OF THE INVENTION a) Field of the Invention

The present invention relates to a reversible thermosensitive recording material for forming an image and erasing the same by utilizing reversible transparency changes of a thermosensitive layer dependant upon temperature.

b) Description of the Prior Art

Japanese Laid-open Patent Application No. 154198/1980 (corresponding to Europian Laid-open Patent Application No. 14826) proposes a reversible thermosensitive recording material with a thermosensitive layer formed by dispersing an organic low molecular substance such as a higher fatty acid in a resin matrix such as a vinyl chloride type resin. The recording material of this sort forms an image and erases the same by utilizing reversible transparency changes of a thermosensitive layer. These recording materials are actually made transparent and opaque by heating. When in case the amount of said organic low molecular substance to said resin matrix is small, the opaque area (white area) of the recording material is low in concentration, while when the amount of the organic low molecular substance to the resin matrix is large, the opaque portion (white portion) is high in concentration but the transparency is low, whereby a sufficient contrast can never be obtained. Further, the temperature range between which the opaque portion is made transparent is narrow, namely about 2°–4° C. Due to this, when making the recording material, that is at least partly opaque, wholly transparent, or forming a colorless (transparent) image on a wholly opaque recording material, there can be observed such defects that temperature control is difficult and accordingly it is difficult to obtain a uniform transparent or opaque image.

SUMMARY OF THE INVENTION

The object of the present invention is to provide a reversible thermosensitive recording material that is capable of forming a high contrast image and facilitating temperature control, whereby a uniform transparent or opaque image can be obtained.

The reversible thermosensitive recording materials according to the present invention include the following three types:

1. A reversible thermosensitive recording material having a thermosensitive layer whose transparency reversibly changes depending upon temperatures, said layer comprising a resin matrix and an organic low molecular substance dispersed in said resin matrix, wherein as said organic low molecular substance, a higher fatty acid having carbon atoms of 16 or more, preferably 16–30, more preferably 16–24, and at least one member of the following compounds (a), (b), (c), (d) and (e) are used in the weight ratio of 95:5–20:80, preferably 90:10–40:60.

(a) a higher fatty acid having carbon atoms of 10–15

(b) a higher alcohol having carbon atoms of 12 or more, preferably 12–24.

(c) a compound represented by the general formula $R_1$-X-$R_2$

[wherein $R_1$ and $R_2$ each represents a substituted or unsubstituted alkyl group or aralkyl group having carbon atoms of 10 or more, preferably 10–30, more preferably 10–24; or represents -$R_3$COO$R_4$ or -$R_5$OCO$R_6$ (wherein $R_3$ and $R_5$ each represents an alkylene group having carbon atoms of 1 or more, preferably 1–30, more preferably 1–24, and $R_4$ and $R_6$ each represents a substituted or unsubstituted alkyl group or aralkyl group having carbon atoms of 10 or more, preferably 10–30, more preferably 10–24), and X represents —O—, —NH—, —S— or —S—S— group].

(d) a compound represented by the general formula $R_{11}$-COO$R_{12}$

[wherein $R_{11}$ represents an alkyl group having carbon atoms of 10 or more, preferably 10–30, more preferably 10–24, and $R_{12}$ represents an alkyl group having carbon atoms of 1 or more, preferably 1–30, more preferably 1–24].

(e) a compound represented by the general formula $C(CH_2OR_{20})_4$

[wherein $R_{20}$ represents a hydrogen atom or -CO$R_{21}$ ($R_{21}$ represents an alkyl group having carbon atoms of 10 or more, preferably 10–30, more preferably 10–24), but both should not be hydrogen simultaneously].

2. A reversible thermosensitive recording material having a thermosensitive layer whose transparency reversibly changes depending upon temperature, said layer comprising a resin matrix and an organic low molecular substance dispersed in said resin matrix, wherein said thermosensitive layer further contains at least one member of the following group of additives.

Group of additives polyhydric alcohol higher fatty acid ester; polyhydric alcohol higher alkylether; lower olefin oxide addition product of polyhydric alcohol higher fatty acid ester, higher alcohol, higher alkylphenol, higher fatty acid higher alkylamine, higher fatty acid amide, fat and oil or polypropylene glycol; Na, Ca, Ba or Mg salt of higher alkylbenzenesulfonic acid; Ca, Ba or Mg salt of higher fatty acid, aromatic carboxylic acid, higher aliphatic sulfonic acid, aromatic sulfonic acid, sulfuric monoester or phosphoric mono- or diester; lower sulfonated oil; poly long-chain alkyl acrylate; acrylic oligomer; poly long-chain alkyl methacrylate; long chain alkyl methacrylate-amine-containing monomer copolyer; styrene-maleic anhydride copolyer; olefin-maleic anhydride copolymer.

3. A reversible thermosensitive recording material having a thermosensitive layer whose transparency reversibly changes depending upon temperature, said layer comprising a resin matrix and an organic low molecular substance dispersed in said resin matrix, wherein said thermosensitive layer further contains at least one member selected from the group consisting of the undermentioned high boiling solvents having boiling points of 200° C. or more.

Group of high boiling solvents tributyl phosphate, tri-2-ethylhexyl phosphate, triphenyl phosphate, tricresyl phosphate, butyl oleate, dimethyl phthalate, diethyl phthalate, dibutyl phthalate, diheptyl phthalate, di-n-octyl phthalate, di-2-ethylhexyl phthalate, diisononyl phthalate, dioctyldecyl phthalate, diisodecyl phthalate, butylbenzyl phthalate, dibutyl adipate, di-n-hexyl adipate, di-2-ethylhexyl adipate, di-2-ethylhexyl azelate, dibutyl sebacate, di-2-ethylhexyl sebacate, diethylene glycol dibenzoate, triethylene glycol di-2-ethylene butylate, methyl acetylricinolate, butyl acetylricinolate, butyl phthalyl butylglycolate, tributyl acetylcitrate, epoxylated soybean oil, and epoxylated tall oil fatty acid 2-ethylhexyl ester.

DETAILED DESCRIPTION OF THE INVENTION

Figure 1:
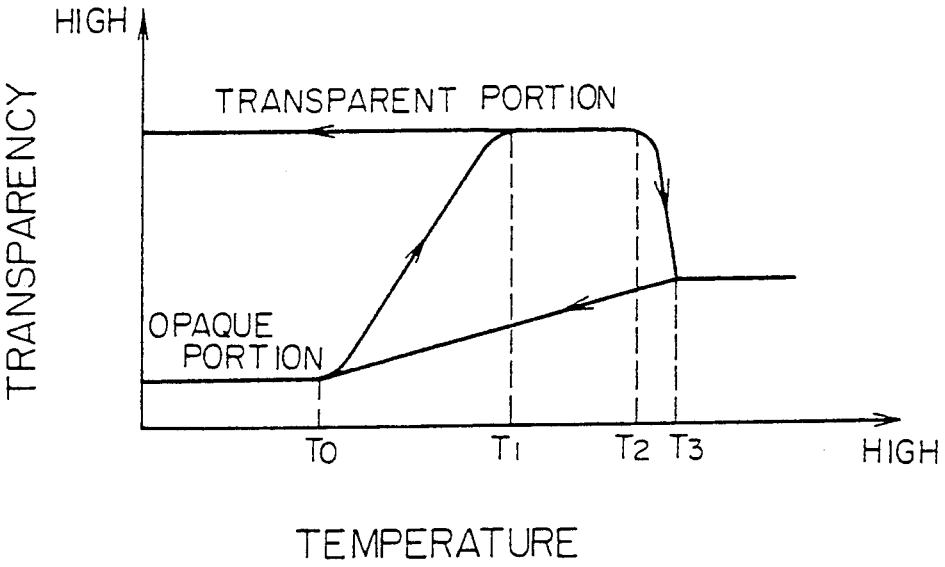
FIG. 1 is a view explaining the principle upon which an image is formed on and erased from the thermosensitive layer of the recording material according to the present invention.

The principle upon which an image is recorded on and erased from the recording material according to the present invention has utilized the transparency change of the thermosensitive layer (or sheet) depending upon temperature. This will be explained with reference to the drawing. In FIG. 1, a thermosensitive layer consisting essentially of a resin matrix and an organic low molecular substance dispersed in said resin matrix is in the white-opaque state at a normal temperature less than, for instance, $T_0$. This layer, when heated to a temperature between $T_1$–$T_2$, becomes transparent, and the layer in this state, when restored to a normal temperature of $T_0$ or less, remains transparent. When heated to a temperature of $T_3$ or more, said layer assumes a semitransparent state between the maximum transparency and the maximum opaque. Next, when this temperature is lowered, the layer is restored to its original white-opaque state without assuming the transparent state again. When this opaque layer is heated to a temperature between $T_0$–$T_1$ and then is cooled to a normal temperature, namely a temperature of $T_0$ or less, said layer may assume a state between transparency and opaque. When said layer, having become transparent at a normal temperature, is heated again to a temperature of $T_3$ or more, and allowed to restore a normal temperature, it comes to restore said white-opaque state again. In other words, said layer can have both opaque and transparent states and their intermediate states at normal temperature.

Accordingly, through the steps of heating the thermosensitive layer wholly to a temperature between $T_1$–$T_2$ by means of a heat roll or the like, thereafter cooling said layer to a normal temperature of $T_0$ or less thereby to make it transparent, and then heating said layer image-wise to a temperature of $T_3$ or more by means of a thermal head or the like thereby to make said portion opaque, there can be formed a white image on this layer. When a colored sheet is arranged under the thermosensitive layer having said white image, this image can be recognized as a white image against the colored background sheet. On the other hand, when heating the above partly opaque thermosensitive layer wholly to a temperature of $T_3$ or more, thereafter allowing the layer to have a normal temperature of $T_0$ or less thereby to make the whole layer white-opaque, and heating the layer image-wise to a temperature between $T_1$–$T_2$ by means of a thermal head or the like thereby to make said portion transparent, there can be formed a transparent image against the white background. When a colored sheet is arranged under the thermosensitive layer having said transparent image, this image can be recognized as an image with the color of the colored sheet against the white background.

The above mentioned recording and erasing operations onto the thermosensitive layer can be repeated $10^4$ times or more.

It has been found that when the organic low molecular substance used in the thermosensitive layer is a fatty acid having carbon atoms of 16 or more, and at least one member of said compounds (a), (b), (c), (d) and (e) are mixed in the specific ratios and used, or when at least one member of said group of additives or high boiling solvents is incorporated in the thermosensitive layer, said mixture, additives or high boiling solvents generates a eutectic phenomenon at the time of heating, whereby the range of temperature $T_1$–$T_2$ for making the thermosensitive layer transparent is changed and enlarged as the mixing ratios change and the temperature control for making the recording material transparent becomes easy as mentioned above, and further even when the ratio of the organic low molecular substance to the resin matrix is enlarged a sufficient transparency can be obtained and contrast is also improved.

The photosensitive recording material of type 1 according to the present invention is generally formed by coating (or impregnating) a thermosensitive layer-forming liquid containing the resin matrix and said specifically combined organic low molecular substance on a support such as paper, plastic film, glass plate, metal plate or the like, coating a mixture obtained by mixing said components while heating on said support or forming said mixture into a film or sheet state. The thermosensitive layer-forming liquid used herein is usually obtained by dissolving both components of the resin matrix and the organic low molecular substance in a solvent, or by grinding or dispersing the organic low molecular substance (insoluble in the solvent for use in the matrix) by various ways. As the solvent, there are enumerated tetrahydrofuran, methyl ethyl ketone, methyl isobutyl ketone, chloroform, carbon tetrachloride, ethanol, toluene, benzene and the like. When a dispersion, or a solution is used, the organic low molecular substance, separates in the form of fine particles and exists in a dispersed state.

The thermosensitive recording materials of types 2 and 3 may be formed by the substantially same procedure as that of type 1 according to the present invention except that said additives or high boiling solvents are added to the thermosensitive layer-forming liquid or blend respectively.

In the thermosensitive recording material of type 1, 2 or 3, the suitable thickness of the thermosensitive layer is about 1–30 micron meter.

The resin matrix used in the thermosensitive layer of each thermosensitive recording material is a material for forming a layer in which the organic low molecular substance has been held in a uniformly dispersed state as well as for influencing the transparency of the thermosensitive layer at the maximum transparent state. For this purpose, the matrix is preferred to be a resin that is superior in transparency, mechanically stable and superior in film formability. As the preferable resin like this, there can be enumerated vinyl chloride type copolymer such as polyvinyl chloride, vinyl chloride—vinyl acetate copolymer, vinyl chloride—vinyl acetate—vinyl alcohol copolymer, vinyl chloride—vinyl acetate—maleic acid copolymer, vinyl chloride—acrylate copolymer or the like; vinylidene chloride type copolymer such as polyvinylidene chloride, vinylidene chloride—vinyl chloride copolymer, vinylidene chloride—acrylonitrile copolymer or the like; polyester; polyamide; polyacrylate or polymethacrylate, or acrylate—methacrylate copolymer; silicone resin or the like. These may be used singly or in the combination of two kinds or more.

The concrete examples of the organic low molecular substance used in the thermosensitive recording material of type 1 are as follows.

As the concrete examples of the higher fatty acid having carbon atoms of 16 or more, there can be enumerated palmitic acid, margaric acid, stearic acid, nonadecanoic acid, eicosanic acid, heneicosanic acid, behenic acid, lignoceric acid, pentacosanic acid, cerotic acid, heptacosanic acid, montanic acid, nonacosanic acid, melissic acid, 2-hexadecenoic acid, trans-3-hexadecenoic acid, 2-heptadecenoic acid, trans-2-octadecenoic acid, cis-2-octadecanoic acid, trans-4-octadecenoic acid, cis-6-octadecenoic acid, elaidic acid, vaccenic acid, erucic acid, brassylic acid, selacholeic acid, trans-selacholeic acid, trans-8, trans-10-octadecadienic acid, linoelaidic acid, α-eleostearic acid, β-eleostearic acid, pseudoeleostearic acid, 12, 20-heneicosadienic acid and the like. These may be used singly or in the combination of two kinds or more.

As the concrete examples of compound (a), there may be enumerated capric acid, undecanoic acid, lauric acid, tridecanoic acid, myristic acid, pentadecanoic acid, 12-methyltridecanoic acid, 2-methyltetradecanoic acid, 13-methyltetradecanoic acid, 10-undecanoic acid and the like.

As the concrete examples of compound (b), there may be enumerated lauryl alcohol, tridecane 1-ol, myristyl alcohol, pentadecane 1-ol, cetyl alcohol, heptadecane 1-ol, stearyl alcohol, nonadecane 1-ol, arachidic alcohol, heneicosanol-1, docosanol-1, tricosanol-1, tetrocosanol-1, pentacosanol-1, hexacosanol-1, heptacosanol-1, octacosanol-1, hexadecane 2-ol, heptadecane 2-ol, octadecane 2-ol, nonadecane 2-ol, eicosane 2-ol, 2-hexadecenol-1 (cis), 2-heptadecenol-1(cis), 2-octadecenol-1 (cis), 2-octadecenol-1(trans), elaidic alcohol, eleostearyl alcohol (β) and the like.

As the concrete examples of compound (c), there may be enumerated $C_{16}H_{33}—O—C_{16}H_{33}$, $C_{16}H_{33}—S—C_{16}H_{33}$,
$C_{18}H_{37}—S—C_{18}H_{37}$, $C_{12}H_{25}—S—C_{12}H_{25}$,
$C_{19}H_{39}—S—C_{19}H_{39}$, $C_{12}H_{25}—S—S—C_{12}H_{25}$,

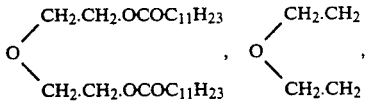

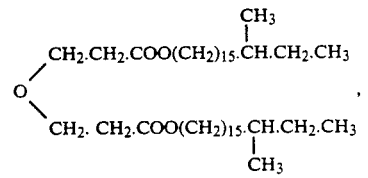

-continued

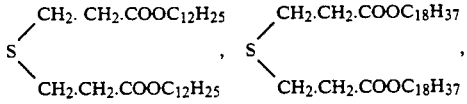

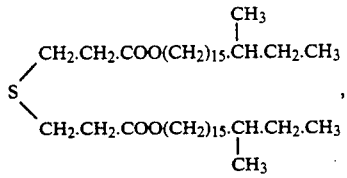

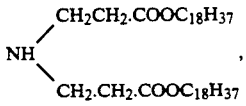

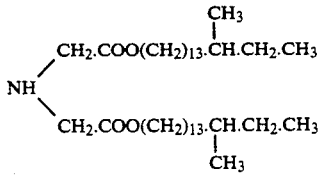

As the concrete examples of compound (d), there may be enumerated methyl nonadecanoate, ethyl nonadecanoate, methyl arachiate, ethyl arachiate, methyl heneicosanate, ethyl heneicosanate, methyl brassidinate, methyl tricosanate, ethyl tricosanate, methyl lignocericate, ethyl lignosericate, methyl cerotate, ethyl cerotate, methyl octacosanoate, ethyl octacosanoate, methyl melissicate, ethyl melissicate, tetradecyl palmitate, penthadecyl palmitate, hexadecyl palmitate, octadecyl palmitate, triacontyl palmitate, methyl stearate, ethyl stearate, stearyl stearate, lauryl stearate, tetradecyl stearate, hexadecyl stearate, heptadecyl stearate, octadecyl stearate, hexacosyl stearate, triocontyl stearate, methyl behenate, ethyl behenate, stearyl behenate, behenyl behenate, docosyl behenate, tetracosyl lignocerate, melissyl melissinate and the like.

The compound (e) can be obtained through the esterification reaction between a higher fatty acid and pentaerythritol $[C(CH_2OH)_4]$.

As the higher fatty acid, there may be enumerated capric acid, undecanoic acid, lauric acid, tridecanoic acid, myristic acid, pentadecanoic acid, palmitic acid, margaric acid, stearic acid, nonadecanoic acid, arachic acid, oleic acid and the like, each having carbon atoms of 10–24. Among them, those having carbon atoms of 16–18 are especially preferable.

As the concrete examples of compound (e), there may be enumerated pentaerythritol.monostearate $[C(CH_2OH)_3(CH_2OOCC_{17}H_{35})]$, pentaerythritol.distearate $[C(CH_2OH)_2(CH_2OOCC_{17}H_{35})]$, pentaerythritol.tristearate $[C(CH_2OH)(CH_2OOCC_{17}H_{35})_3]$, pentaerythritol.tetrastearate $[C(CH_2OOC_{17}H_{35})_4]$, pentaerythritol monolaurate, pentaerythritol dilaurate, pentaerythritol trilaurate, pentaerythritol tetralaurate, pentaerythritol monopalmitate, pentaerythritol dipalmitate, pentaerythritol tripalmitate, pentaerythritol tetrapalmitate, pentaerythritol dibehenate, pentaerythritol tribehenate, pentaerythritol tetrabehenate and the like.

In the thermosensitive recording material of type 1, the mixing ratio of the higher fatty acid having carbon atoms of 16 or more with at least one member of compounds (a), (b), (c), (d) and (e) used as the organic low molecular substance is in the range of 95:5-20:80 (by weight), preferably 90:10-40:60 (by weight). In any case where the mixing ratio deviates from this range, the temperature range for making the thermosensitive layer transparent is not widened.

In the thermosensitive recording material of type 1, furthermore, the ratio of the organic low molecular substance to the resin matrix in the thermosensitive layer is preferably about 2:1-1:16, more preferably 2:1-1:5. When the ratio of the matrix is below this, it becomes difficult to form a film that can hold the organic molecular substance within the matrix, when said ratio is over this, the operation of making the thermosensitive layer opaque becomes difficult because the amount of the organic low molecular substance is small.

Next, the organic low molecular substance used in each of the thermosensitive material of type 2 and type 3 may be selected suitably in response to the choice of temperatures $T_0$-$T_5$ in FIG. 1, but it is desirable that the organic low molecular substance should have a melting point of about 30°-200° C., in particular about 50°-150° C.

As the organic low molecular substance, there may be enumerated alkanol; alkanediol; halogenoalkanol or halogenoalkanediol; alkylamine; alkane; alkene; alkyne; halogenoalkane; halogenoalkene, halogenoalkyne; cycloalkane; cycloalkene; cycloalkyne; saturated or unsaturated mono-or di-carboxylic acids or their esters, amides or ammonium salt; saturated or unsaturated halogenofatty acids or their esters, amides, or ammonium salts; allyl carboxylic acids or their esters, amides or ammonium salts; halogenoallylcarboxylic acids or their esters amides, or ammonium salts; thioalcohol; thio carboxylic acids or their esters, amines, or ammonium salts; carboxylic esters of thioalcohol or the like. These may be used singly or in combination of two kinds or more. These compounds are desired to have carbon atoms of 10-60, preferably 10-38, more preferably 10-30. The alcohol group in the ester may be saturated or unsaturated, or substituted or unsubstituted with halogen. At any rate, it is preferable that the organic low molecular substance should contain at least one member of oxygen, nitrogen, sulfur and halogen, for instance —OH, —COOH, —CONH, —COOR, —NH—, —$NH_2$—, —S—, —S—S—, —O—, halogen or the like.

As the concrete examples of these organic low molecular substances, there may be enumerated the higher fatty acid having carbon atoms of 16 or more, compounds (a)-(e) and the like as explained in the thermosensitive recording material of type 1, and more desirably there are enumerated higher fatty acids having carbon atoms of 16 or more, preferably 16-30, more preferably 16-24. In addition, there may be enumerated higher fatty acids such as dodecanoic acid, arochic acid, oleic acid and the like; esters of higher fatty acids such as octadecyl laurate and the like.

The additives or high boiling solvents used in the thermosensitive recording materials of types 2 and 3 are materials that contribute to enlarging the range of temperatures for making the thermosensitive layer transparent and improving the contrast, and normally exist, taking the state compatible with organic low molecular substances or the resin matrix, in the thermosensitive layer or thermosensitive sheet. The concrete examples of said additives are as follows, wherein EO represents ethylene oxide, PO represents propylene oxide, EG represents ethylene glycol, PEG represents polyethylene glycol, and the bracketed numerical values following EO and PO represent addition mol numbers respectively.

Concrete examples of additives glyceryl monocaprylate, glyceryl monomyristate, glyceryl monostearate, glyceryl monooleate, glyceryl distearate, glyceryl dioleate, decaglyceryl monolaurate, decaglyceryl monomyristate, decaglyceryl monostearate, decaglyceryl monooleate, decaglyceryl monolinolate, decaglyceryl monoisostearate, decaglyceryl distearate, decaglyceryl dioleate, decaglyceryl diisostearate, decaglyceryl tristearate, decaglyceryl trioleate, decaglyceryl triisostearate, decaglyceryl pentastearate, decaglyceryl pentaoleate, decaglyceryl pentaisostearate, decaglyceryl heptastearate, decaglyceryl heptaoleate, decaglyceryl heptaisostearate, decaglyceryl decastearate, decaglyceryl decaoleate, decaglyceryl decaisostearate, diglyceryl monostearate, diglyceryl monooleate, diglyceryl dioleate, diglyceryl monoisostearate, tetragylceryl monostearate, tetraglyceryl monooleate, tetraglyceryl tristearate, tetraglyceryl pentastearate, tetraglyceryl pentaoleate, hexaglyceryl monolaurate, hexaglyceryl monomyristate, hexaglyceryl monostearate, hexaglyceryl monooleate, hexaglyceryl tristearate, hexaglyceryl pentastearate, hexaglyceryl pentaoleate, hexaglyceryl polyricinolate, propylene glycol monostearate, pentaerythritol monostearate, pentaerythritol monopalmitate, pentaerythritol beef tallow fatty acid ester, sorbitan monocaprylate, sorbitan-monolaurate, sorbitan monopalmitate, sorbitan monostearate, sorbitan sequistearate, sorbitan tristearate, sorbitan monooleate, sorbitan sesquioleate, sorbitan trioleate, sorbitan monoisostearate, sorbitan sesquiisostearate, sorbitan monotall oil fatty acid ester, sorbitan sesquitall oil fatty acid ester, sorbitan tritall oil fatty acid ester, EG monostearate, EG distearate, PEG monolaurate, PEG monostearate, PEG monooleate, PEG dilaurate, PEG distearate, PEG dioleate, glyceryl monooleate EO(5), glyceryl monooleate EO(15), glyceryl monostearate EO(5), glyceryl monostearate EO(15), glycerol plant oil fatty acid ester EO(5), glycerol plant oil fatty acid ester EO(15), sorbitan monolaurate EO(20), sorbitan monopalmitate EO(20), sorbitan monostearate EO(20), sorbitan tristearate EO(20), sorbitan monostearate EO(6), sorbitan monooleate EO(20), sorbitan trioleate EO(20), sorbitan monooleate EO(6), sorbitan monoisostearate EO(20), laurylether EO(2), laurylether EO(4, 2), laurylether EO(9), lauryl ether EO(21), laurylether EO(25), cetylether EO(2), cetylether EO(5, 5), cetylether EO(7), cetylether EO(10), cetylether EO(15), cetylether EO(20), cetylether EO(23), cetylether EO(25), cetylether EO(30), cetylether EO(40), stearylether EO(2), stearylether EO(4), stearylether EO(20), oleyl ether EO(7), oleyl ether EO(10), oleyl ether EO(15), oleyl ether EO(20), oleyl ether EO(50), behenyl ether EO(5), behenyl ether EO(10), behenyl ether EO(20), behenyl ether EO(30), nonylphenol EO(4), nonylphenol EO(6), nonylphenol EO(7), nonylphenol EO(10), nonylphenol EO(12), nonylphenol EO(14), nonylphenol EO(16), nonylphenol EO(20), nonylphenol EO(40), sorbitol hexastearate EO(6), sorbitol tetrastearate EO(60), sorbitol tetraoleate EO(6), sorbitol tetraoleate EO(30), sorbitol tetraoleate EO(40), sorbitol tetraoleate EO(60), sorbitol monolaurate EO(6), monolaurate EO(10), monostearate EO(1), monostearate EO(2), monostearate EO(4), monostearate EO(10), monostearate EO(25), monostearate EO(40), monostearate EO(45), monostearate EO(55), monooleate EO(2), monooleate EO(6), monooleate EO(10), stearylamine EO(5), stearylamine EO(10), stearylamine EO(15), oleyl amine EO(5), oleyl amine EO(10), oleyl amine EO(15), stearylpropylenediamine EO(8), stearic amide EO(4), stearic amide EO(15), stearic amide EO(5), oleic amide EO(10), oleic amide EO(15), lanolin alcohol EO(1), lanolin alcohol EO(5), lanolin alcohol EO(10), lanolin alcohol EO(20), lanolin alcohol EO(40), sorbitol beeswax EO(6), sorbitol beeswax EO(20), cetylether EO(1)PO(4), cetylether EO(10-)PO(4), cetylether EO(20)PO(4), cetylether EO(1-)PO(8), cetylether EO(20)PO(8), decyl tetradecylether EO(12)PO(6), decyl tetradecylether EO(20)PO(6), decyl tetradecylether EO(30)PO(6), Ba dodecylbenzenesulfonate, Mg dodecylbenzenesulfonate, Ca stearylbenzenesulfonate, Ba stearylbenzenesulfonate, Mg stearylbenzenesulfonate, Ca eicosylbenzenesulfonate, Ba eicosylbenzenesulfonate, Mg eicosylbenzenesulfonate, Na eicosylbenzenesulfonate, Turkey red oil (low-degree sulfated castor oil) having the following structural formula:

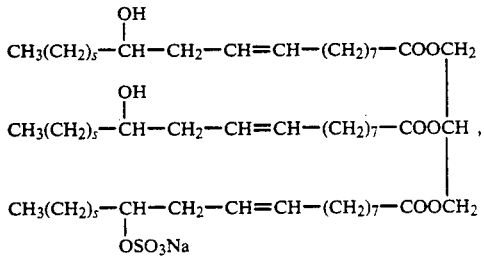

low-degree sulfated olive oil having the following structural formula:

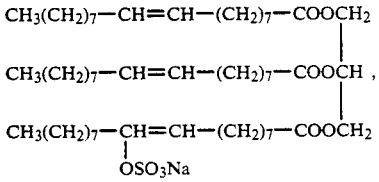

Olefin-maleic anhydride copolymer having the following structural formula:

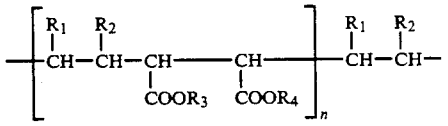

(wherein $R_1$, $R_2$, $R_3$ and $R_4$ each represents hydrogen or an alkyl group having carbon atoms of 1-20, and n is an integer of 10-200).

Styrene-maleic anhydride copolymer having the following structural formula:

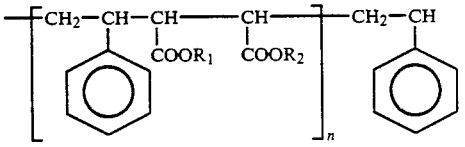

(wherein $R_1$ and $R_2$ each represents hydrogen or an alkyl group having carbon atoms of 1-20, and n is an integer of 10-200), Acrylic oligomer having the following structural formula:

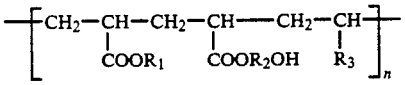

[wherein $R_1$ and $R_3$ each represents hydrogen or an alkyl group having carbon atoms of 1-20, $R_2$ represents $-(CH_2)_m$ (m=1-20), and n is an integer of 5-30], and 2,4,7,9-tetramethyl-5-decyne-4,7-diol having the following structural formula:

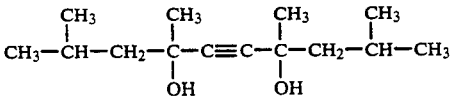

The ratio of the organic low molecular substance to the resin matrix in each of the thermosensitive recording materials of types 2 and 3 may be the same as in the thermosensitive recording material of type 1, but the most suitable ratio for further improving contrast is 2:1-1:2.5.

The amount of the additive used per part by weight of the resin matrix is 0.005-1 part by weight, preferably 0.01-0.3 part by weight. In case this amount is less than 0.005 part, the widening of the transparence-producing temperature range is difficult, whilst in case said amount is more than 1 part, the film formation becomes difficult.

On the other hand, the amount of the high boiling solvent used per part by weight of the resin matrix is 0.01-1 part by weight, preferably 0.05-0.5 part by weight. When this amount is less than 0.01 part the widening of the transparence-producing temperature range and the formation of a transparent image by the use of a very small amount of energy is difficult, whilst when said amount is more than 1 part the mechanical strength of the film is lost.

When the additive is used with the high boiling solvent in the thermosensitive recording material of type 2, and the high boiling solvent is used with the additive of the thermosensitive recording material of type 3, there can be formed a transparent image by means of a smaller amount of energy (for instance the energy of the thermal head) than the case where the additive or high boiling solvent is singly used. The amount of the high boiling solvent used in the thermosensitive recording material of type 2 and the amount of the additive used in the thermosensitive material of type 3 are as mentioned above.

The reversible thermosensitive recording material according to the present invention has been constructed as above, and is advantageous in that the temperature range for making the thermosensitive layer transparent is widened, and consequently the temperature control for making the thermosensitive layer transparent becomes easy, whereby a uniform transparent image can be obtained and further the contrast between the white-opaque portion and the transparent portion is improved.

DESCRIPTION OF THE PREFERRED EMBODIMENTS

The present invention will be explained in detail with reference to examples hereinafter. Every part used herein is part by weight.

| Example 1 | |
|---|---|
| Behenic acid | 95 parts |
| Stearyl alcohol | 5 parts |
| Vinyl chloride - vinyl acetate copolymer (VYHH produced by UCC Company) | 200 parts |
| Tetrahydrofuran | 1000 parts |

A solution of above components was coated on a 75 micron meter-thick polyester film by means of a wire bar, and thermally dried to form a 15 micron meter-thick thermosensitive layer thereon. A reversible thermosensitive recording material of type 1 was thus prepared.

EXAMPLE 2

A reversible thermosensitive recording material of type 1 was prepared according to the same procedure as in Example 1 except that 95 parts of behenic acid were reduced to 80 parts, and 5 parts of stearyl alcohol were increased to 20 parts.

EXAMPLE 3

A reversible thermosensitive recording material of type 1 was prepared according to the same procedure as in Example 1 except that 95 parts of behenic acid were reduced to 30 parts, and 5 parts of stearyl alcohol were increased to 70 parts.

COMPARATIVE EXAMPLE 1

A reversible thermosensitive recording material was prepared according to the same procedure as in Example 1 except that 95 parts of behenic acid were increased to 98 parts, and 5 parts of stearyl alcohol were reduced to 2 parts.

COMPARATIVE EXAMPLE 2

A reversible thermosensitive recording material was prepared according to the same procedure as in Example 1 except that 95 parts of behenic acid were reduced to 10 parts, and 5 parts of stearic alcohol were increased to 90 parts.

EXAMPLES 4–13

Reversible thermosensitive recording materials of type 1 were prepared according to the same procedure as in Example 2 except that the same amount of compounds shown in the following table-1 were employed in the place of stearyl alcohol.

EXAMPLE 14

A reversible thermosensitive recording material of type 1 was prepared according to the same procedure as in Example 2 except that vinyl chloride-vinyl acetate copolymer was used in the amount of 100 parts.

COMPARATIVE EXAMPLE 3

A reversible thermosensitive recording material was prepared according to the same procedure as in Example 1 except that 5 parts of stearyl alcohol were removed and 95 parts of behenic acid were increased to 100 parts.

COMPARATIVE EXAMPLE 4

A reversible thermosensitive recording material was prepared according to the same procedure as in Example 1 except that 95 parts of behenic acid were removed and 5 parts of stearyl alcohol were increased to 100 parts.

Comparative Example 5

A reversible thermosensitive recording material was prepared according to the same procedure as in Comparative Example 3 except that vinyl chloride-vinyl acetate was employed in the amount of 100 parts.

The thus obtained thermosensitive recording materials of Examples 1–14 and Comparative Examples 1–5 each displayed an opaque white.

Next, each thermosensitive recording material was heated from 50° C. by 1° C. up to 80° C., thereafter exposed to atmosphere and cooled to normal temperature.

This material was placed on a black drawing paper, and its reflection density was measured by means of a Macbeth densitometer. The temperature at which said reflection density exceeded 1.0 was named transparence-producing temperature, and its scope (width) was indicated. The minimum value of this density was named an opaque portion (white portion) density, while the maximum value of this density was named a transparent portion density. The obtained results are as shown in the following Table-1.

TABLE 1

| | Compound used in place of stearyl alcohol | Transparence-producing temperature range (°C.) | Transparence-producing temperature width (°C.) | White-portion density | Transparent portion density |
|---|---|---|---|---|---|
| Example 1 | — | 61~70 | 10 | 0.46 | 1.35 |
| Example 2 | — | 56~70 | 15 | 0.47 | 1.38 |
| Example 3 | — | 62~70 | 9 | 0.45 | 1.39 |
| Example 4 | myristyl alcohol | 60~69 | 10 | 0.48 | 1.36 |
| Example 5 | docosanol-1 | 59~70 | 12 | 0.46 | 1.38 |
| Example 6 | tetracosanol-1 | 57~67 | 11 | 0.44 | 1.38 |
| Example 7 | eicosane 2-ol | 57~68 | 12 | 0.48 | 1.40 |
| Example 8 | 2-octadecenol-1(trans) | 60~69 | 10 | 0.46 | 1.39 |
| Example 9 | eleostearyl (β) | 59~69 | 11 | 0.45 | 1.37 |
| Example 10 | lauric acid | 60~70 | 11 | 0.47 | 1.35 |
| Example 11 | myristic acid | 62~70 | 9 | 0.47 | 1.38 |
| Example 12 | 12-methyltridecanoic acid | 60~68 | 9 | 0.45 | 1.35 |
| Example 13 | 10-undecylic acid | 60~69 | 10 | 0.48 | 1.39 |
| Example 14 | — | 65~70 | 6 | 0.46 | 1.38 |

TABLE 1-continued

| | Compound used in place of stearyl alcohol | Transparence-producing temperature range (°C.) | Transparence-producing temperature width (°C.) | White-portion density | Transparent portion density |
|---|---|---|---|---|---|
| Comparative Example 1 | — | 67~70 | 4 | 0.48 | 1.34 |
| Comparative Example 2 | — | 71 | 1 | 0.52 | 1.20 |
| Comparative Example 3 | — | 70~71 | 2 | 0.54 | 1.36 |
| Comparative Example 4 | — | 71 | 1 | 0.50 | 1.18 |
| Comparative Example 5 | — | none | 0 | 0.47 | 0.95 |

Example 15

| | |
|---|---|
| Behenic acid | 95 parts |
| $S(CH_2CH_2COOC_{18}H_{37})_2$ | 5 parts |
| Vinyl chloride - vinyl acetate copolymer (VYHH produced by UCC company) | 200 parts |
| Tetrahydrofuran | 1000 parts |

A solution of above components was coated on a 75 micron meter-thick polyester film by means of a wire bar, and dried at 150° C. to form a 15 micron meter-thick thermosensitive layer thereon. Thus, a reversible thermosensitive recording material of type 1 was prepared.

EXAMPLE 16

A reversible thermosensitive recording material of type 1 was prepared according to the same procedure as in Example 15 except that 95 parts of behenic acid were reduced to 80 parts, and 5 parts of $S(CH_2CH_2COOC_{18}H_{37})_2$ were increased to 20 parts.

EXAMPLE 17

A reversible thermosensitive recording material of type 1 was prepared according to the same procedure as in Example 15 except that 95 parts of behenic acid were reduced to 30 parts, and 5 parts of $S(CH_2CH_2COOC_{18}H_{37})_2$ were increased to 70 parts.

Comparative Example 6

A reversible thermosensitive recording material was prepared according to the same procedure as in Example 15 except that 95 parts of behenic acid were increased to 98 parts and 5 parts of $S(CH_2CH_2COOC_{18}H_{37})_2$ were reduced to 2 parts.

Comparative Example 7

A reversible thermosensitive recording material was prepared according to the same procedure as in Example 15 except that 95 parts of behenic acid were reduced to 10 parts and 5 parts of $S(CH_2CH_2COOC_{18}H_{37})_2$ were increased to 90 parts.

EXAMPLE 18

A reversible thermosensitive recording material of type 1 was prepared according to the same procedure as in Example 16 except that stearyl stearate was used in the place of $S(CH_2CH_2COOC_{18}H_{37})_2$.

EXAMPLE 19

A reversible thermosensitive recording material of type 1 was prepared according to the same procedure as in Example 16 except that pentaerythritol monostearate was used in the place of $S(CH_2CH_2COOC_{18}H_{37})_2$.

Comparative Example 8

A reversible thermosensitive recording material was prepared according to the same procedure as in Example 15 except that 5 parts of $S(CH_2CH_2COOC_{18}H_{37})_2$ were removed and 95 parts of behenic acid were increased to 100 parts.

Comparative Example 9

A reversible thermosensitive recording material was prepared according to the same procedure as in Example 15 except that 95 parts of behenic acid were removed and 5 parts of $S(CH_2CH_2COOC_{18}H_{37})_2$ were increased to 100 parts.

The thus obtained thermosensitive recording materials of Examples 15–19 and Comparative Examples 6–9 were all opaque and white.

EXAMPLE 20

A reversible thermosensitive recording material of type 1 was prepared according to the same procedure as in Example 16 except that 100 parts of vinyl chloride-vinyl acetate copolymer were used.

Comparative Example 10

A reversible thermosensitive recording material was prepared according to the same procedure as in Comparative Example 8 except that 100 parts of vinyl chloride-vinyl acetate copolymer were used.

Each of the thermosensitive recording materials of Examples 15–20 and Comparative Examples 6–10 was measured in the respects of transparence-producing temperature range, white area density and transparent area density by means of the same measuring method as used in Examples 1–14 except that the recording material was heated from 50° C. by 2° C. up to 80° C. The obtained results are as shown in the following Table-2.

TABLE 2

| | Transparence-producing temperature range (°C.) | Transparence-producing temperature width (°C.) | White portion density | Transparent portion density |
|---|---|---|---|---|
| Example 15 | 66~72 | 7 | 0.52 | 1.41 |
| Example 16 | 62~70 | 9 | 0.53 | 1.40 |
| Example 17 | 60~68 | 9 | 0.51 | 1.42 |
| Example 18 | 62~72 | 11 | 0.50 | 1.44 |
| Example 19 | 62~70 | 9 | 0.50 | 1.40 |
| Example 20 | 64~70 | 7 | 0.53 | 1.41 |
| Comparative Example 6 | 70~72 | 3 | 0.52 | 1.42 |
| Comparative | 62~64 | 3 | 0.51 | 1.40 |

TABLE 2-continued

| | Transparence-producing temperature range (°C.) | Transparence-producing temperature width (°C.) | White portion density | Transparent portion density |
|---|---|---|---|---|
| Example 7 | | | | |
| Comparative Example 8 | 70~72 | 3 | 0.54 | 1.40 |
| Comparative Example 9 | 60~62 | 3 | 0.53 | 1.41 |
| Comparative Example 10 | 72 | less than 2 | 0.49 | 1.00 |

| Example 21 | |
|---|---|
| Behenic acid | 10 parts |
| Olefin - maleic anhydride copolymer (Homogenol M-8 produced by Kao Sekken K.K.) | 3 parts |
| vinyl chloride - vinyl acetate copolymer (VYHH produced by UCC Company) | 20 parts |
| Tetrahydrofuran | 100 parts |

A solution of above components was coated on a 75 micron meter-thick polyester film by means of a wire bar, and dried at 150° C. to form a 15 micron meter-thick thermosensitive layer. A white-opaque reversible thermosensitive material of type 2.

EXAMPLE 22

A white-opaque reversible thermosensitive recording material of type 2 was prepared according to the same procedure as in Example 21 except that 20 parts of vinyl chloride-vinyl acetate copolymer was reduced to 7 parts.

EXAMPLES 23–49

A white-opaque reversible thermosensitive recording material of type 2 was prepared according to the same procedure as in Example 21 except that additives shown in the following Table-3 were used in place of the olefin-maleic anhydride copolymer.

Comparative Example 11

A white-opaque reversible thermosensitive recording material was prepared according to the same procedure as in Example 21 except that 3 parts of olefin-maleic anhydride copolymer were removed.

Next, each of the thermosensitive recording materials of Examples 21–49 and Comparative Example 11 was measured with respect to the transparence-producing temperature width, while portion density were measured and transparent portion density by means of the same measuring method as used in Examples 1–14, thereby obtaining the results as shown in the following Table-3. In this connection, it is to be noted that Examples 21–49 are each concerned with the instance where the ratio of the organic low molecular substance to the resin matrix in the thermosensitive recording material of type 2 is in the optimum range.

TABLE 3

| | Additive | Transparence-producing temperature width | White portion density | Transparent portion density |
|---|---|---|---|---|
| Example 21 | Olefin-maleic anhydride copolymer | 14 | 0.38 | 1.40 |
| Example 22 | " | 10 | 0.32 | 1.37 |
| Example 23 | Acrylic oligomer* | 13 | 0.36 | 1.38 |
| Example 24 | 2,4,7,9-tetramethyl-5-decyne-4,7-diol | 14 | 0.39 | 1.39 |
| Example 25 | sorbitan monolaurate | 8 | 0.43 | 1.36 |
| Example 26 | sorbitan monooleate | 10 | 0.42 | 1.35 |
| Example 27 | sorbitan monoisostearate | 12 | 0.39 | 1.38 |
| Example 28 | glyceryl monostearate | 11 | 0.43 | 1.38 |
| Example 29 | decaglyceryl monooleate | 7 | 0.41 | 1.33 |
| Example 30 | propylene glycol monostearate | 11 | 0.40 | 1.37 |
| Example 31 | sorbitan monooleate EO (20) | 10 | 0.43 | 1.39 |
| Example 32 | sorbite hexastealate EO (60) | 8 | 0.42 | 1.37 |
| Example 33 | monostearate EO (2) | 11 | 0.39 | 1.36 |
| Example 34 | monostearate EO (40) | 8 | 0.38 | 1.39 |
| Example 35 | cetylether EO (7) | 9 | 0.40 | 1.38 |
| Example 36 | cetylether EO (15) | 6 | 0.43 | 1.36 |
| Example 37 | cetylether EO (40) | 10 | 0.39 | 1.36 |
| Example 38 | cetylether EO (20) PO (8) | 9 | 0.38 | 1.37 |
| Example 39 | nonyl phenyl ether EO (5) | 8 | 0.40 | 1.37 |
| Example 40 | nonyl phenyl ether EO (10) | 7 | 0.44 | 1.39 |
| Example 41 | nonyl phenyl ehter EO (20) | 8 | 0.40 | 1.39 |
| Example 42 | lanolin alcohol EO (10) | 8 | 0.43 | 1.38 |
| Example 43 | lanolin alcohol EO (40) | 9 | 0.40 | 1.36 |
| Example 44 | stearic amide EO (4) | 10 | 0.43 | 1.37 |
| Example 45 | oleyl amine EO (10) | 10 | 0.39 | 1.38 |
| Example 46 | polypropylene glycol ethylene oxide adduct | 10 | 0.40 | 1.36 |
| Example 47 | Ca dodecylbenzenesulfonate | 11 | 0.41 | 1.39 |
| Example 48 | Na eicosylbenzenesulfonate | 8 | 0.42 | 1.38 |
| Example 49 | Turkey red oil | 9 | 0.40 | 1.39 |
| Comparative Example 11 | — | 2 | 0.43 | 1.25 |

*KD-140 produced by Kyoei Sha Yushi Kagaku Kogyo K.K.

EXAMPLES 50–77

White-opaque reversible thermosensitive recording materials of type 2 were prepared by coating a solution of 10 parts of behenic acid, 3 parts of an additive shown in the following Table-4, 40 parts of a vinyl chloride-vinyl acetate copolymer (VYHH produced by UCC Company) and tetrahydrofuran on 75 micron meter-thick polyester films by means of a wire bar, and drying at 150° C. to form 15 micron meter-thick thermosensitive layers respectively.

Next, each of the thermosensitive recording materials of Examples 50–77 and Comparative Example 12 was measured with respect to the transparence-producing temperature, white portion density and transparent portion density by means of the same measuring method as used in Examples 1–14, thereby obtaining the results as shown in the following Table-4. In this connection, it is to be noted that Examples 50–77 are each concerned with the instance where the ratio of the organic low molecular substance to the resin matrix in the thermosensitive recording material of type 2 is not in the optimum range.

TABLE 4

| | Additive | Transparence-producing temperature width | White portion density | Transparent portion density |
|---|---|---|---|---|
| Example 50 | Olefin-maleic anhydride copolymer*1 | 15 | 0.54 | 1.40 |
| Example 51 | Acrylic oligomer*2 | 13 | 0.55 | 1.38 |
| Example 52 | 2,4,7,9-tetramethyl-5-decyne-4,7-diol | 14 | 0.56 | 1.39 |
| Example 53 | sorbitan monolaurate | 8 | 0.61 | 1.35 |
| Example 54 | sorbitan monooleate | 9 | 0.62 | 1.36 |
| Example 55 | sorbitan monoisostearate | 13 | 0.57 | 1.39 |
| Example 56 | glyceryl monostearate | 10 | 0.59 | 1.37 |
| Example 57 | decaglyceryl monooleate | 8 | 0.58 | 1.33 |
| Example 58 | propyrene glycol monostearate | 10 | 0.57 | 1.36 |
| Example 59 | sorbitan monooleate EO (20) | 9 | 0.61 | 1.38 |
| Example 60 | sorbite hexastealate EO (60) | 9 | 0.60 | 1.37 |
| Example 61 | monostearate EO (2) | 10 | 0.57 | 1.37 |
| Example 62 | monostearate EO (40) | 9 | 0.58 | 1.38 |
| Example 63 | cetylether EO (7) | 8 | 0.60 | 1.39 |
| Example 64 | cetylether EO (15) | 7 | 0.61 | 1.35 |
| Example 65 | cetylether EO (40) | 9 | 0.57 | 1.36 |
| Example 66 | cetylether EO (20) PO (8) | 10 | 0.56 | 1.36 |
| Example 67 | nonyl phenyl ether EO (5) | 7 | 0.59 | 1.37 |
| Example 68 | nonyl phenyl ether EO (10) | 8 | 0.62 | 1.40 |
| Example 69 | nonyl phenyl ether EO (20) | 8 | 0.58 | 1.38 |
| Example 70 | lanolin alcohol EO (10) | 8 | 0.61 | 1.34 |
| Example 71 | lanolin alcohol EO (40) | 10 | 0.57 | 1.38 |
| Example 72 | stearic amide EO (4) | 9 | 0.60 | 1.39 |
| Example 73 | oleyl amine EO (10) | 9 | 0.57 | 1.35 |
| Example 74 | polypropylene glycol ethylene oxide adduct | 11 | 0.60 | 1.38 |
| Example 75 | Ca dodecylbenzene sulfonate | 10 | 0.62 | 1.39 |
| Example 76 | Na eicosylbenzene sulfonate | 9 | 0.62 | 1.36 |
| Example 77 | Turkey red oil | 8 | 0.61 | 1.40 |
| comparative Example 12 | — | 3 | 0.60 | 1.32 |

Note)
*1Homogenol M-8 produced by Kaosekken K.K.
*2KD-140 Kyoei Sha Yushi Kagaku Kogyo K.K.

EXAMPLES 78–82

White-opaque reversible thermosensitive recording materials of type 3 were prepared by coating a solution of 10 parts of behenic acid, 6 parts of a high boiling solvent shown in the following Table-5, 28 parts of a vinyl chloride-vinyl acetate copolymer (VYHH produced by UCC Company) and 200 parts of tetrahydrofuran on 75 micron meter-thick polyester films by means of a wire bar, and drying to form 15 micron meter-thick thermosensitive layers respectively.

Next, each of the thermosensitive recording materials of Examples 78–82 and Comparative Example 13 was measured with respect to the transparence-producing temperature width, white portion density and transparent portion density by means of the same measuring method as used in Examples 1–14, thereby obtaining the results as shown in the following Table-5.

TABLE 5

| | High boiling solvent | Transparence-producing temperature width (°C.) | White portion density | Transparent portion density |
|---|---|---|---|---|
| Example 78 | di-2-ethylhexyl adipate | 12 | 0.48 | 1.38 |
| Example 79 | tricresyl phosphate | 10 | 0.47 | 1.39 |
| Example 80 | dibutyl phthalate | 9 | 0.47 | 1.38 |
| Example 81 | butyl oleate | 11 | 0.48 | 1.37 |
| Example 82 | methyl acetylricinoleate | 10 | 0.49 | 1.38 |
| Control Example 13 | none | 3 | 0.54 | 1.32 |

EXAMPLE 83

A white-opaque reversible thermosensitive recording materials comprising the combination of types 2 and 3 was prepared by coating a solution of 10 parts of behenic acid, 25 parts of a vinyl chloride-vinyl acetate copolymer (VYHH produced by UCC Company), 6 parts of di-2-ethylhexyl adipate, 2 parts of glyceryl monostearate and 157 parts of tetrahydrofuran on a 75 micron meter-thick polyester film by means of a wire bar, and thermally drying to form a 15 micron meter-thick thermosensitive layer.

EXAMPLE 84

A white-opaque reversible thermosensitive recording material comprising the combination of types 2 and 3 was prepared according to the same procedure as in Example 83 except that glyceryl monostearate was replaced by an olefin-maleic anhydride copolymer (Homogenol M-8 produced by Kao K.K.).

EXAMPLE 85

A white-opaque reversible thermosensitive recording material comprising the combination of types 2 and 3 was prepared according to the same procedure as in Example 83 except that glyceryl monostearate was replaced by sorbitan monooleate.

EXAMPLE 86

A white-opaque reversible thermosensitive recording material comprising the combination of types 2 and 3 was prepared according to the same procedure as in Example 83 except that glyceryl monostearate was replaced by an acrylic oligomer (KD-140 produced by Kyoei Sha Yushi Kagaku Kogyo K.K.).

EXAMPLE 87

A white-opaque reversible thermosensitive recording material comprising the combination of types 2 and 3 was prepared according to the same procedure as in Example 83 except that glyceryl monostearate was replaced by EO (40) monostearate.

EXAMPLE 88

A white-opaque reversible thermosensitive recording material comprising the combination of types 2 and 3 was prepared according to the same procedure as in Example 83 except that glyceryl monostearate was replaced by EO (40) lanolin alcohol.

EXAMPLE 89

A white-opaque reversible thermosensitive recording material comprising the combination of types 2 and 3 was prepared according to the same procedure as in Example 83 except that di-2-ethylhexyl adipate was replaced by dibutyl phthalate.

EXAMPLE 90

A white-opaque reversible thermosensitive recording material comprising the combination of types 2 and 3 was prepared according to the same procedure as in Example 83 except that di-2-ethylhexyl adipate was replaced by tricresyl phosphate.

Next, a transparent image was formed by applying an energy of 0.7 mJ/dot onto each of the thermosensitive recording materials of Examples 83–90 by means of a thermal head (a thin-film line head of 8 dot/mm). The same was placed on a black drawing paper, and its reflection density was measured by means of Macbeth densitometer RD514.

The obtained results are as shown in the following Table-6.

TABLE 6

| | Image portion density | Non-image protion density |
|---|---|---|
| Example 83 | 1.20 | 0.42 |
| Example 84 | 1.15 | 0.47 |
| Example 85 | 1.18 | 0.44 |
| Example 86 | 1.10 | 0.45 |
| Example 87 | 1.14 | 0.43 |
| Example 88 | 1.16 | 0.47 |
| Example 89 | 1.05 | 0.48 |
| Example 90 | 1.02 | 0.49 |

What is claimed is:

1. A reversible thermosensitive recording material comprising a support with a thermosensitive layer whose transparency reversibly changes depending on the temperature, said layer consisting essentially of a resin matrix, an organic low molecular weight substance dispersed in the resin matrix and at least one additive selected from the group consisting of: a polyhydric alcohol higher fatty acid ester, a polyhydric alcohol higher alkylether, a lower olefin oxide addition product of a polyhydric alcohol higher fatty acid ester, a higher alcohol, a higher alkylphenol, a higher fatty acid, a higher alkylamine, a higher fatty acid amide, a fat, an oil, propylene glycol, acetylene glycol, a sodium salt of a higher alkylbenzenesulfonic acid, a calcium salt of a higher alkylbenzenesulfonic acid, a barium salt of a higher alkylbenzenesulfonic acid, a magnesium salt of a higher alkylbenzenesulfonic acid, a calcium salt of a higher fatty acid, a barium salt of a higher fatty acid, a magnesium salt of a higher fatty acid, an aromatic carboxylic acid, a higher aliphatic sulfonic acid, an aromatic sulfonic acid, a sulfuric mono-ester, a phosphoric mono-ester, a phosphoric diester, a lower sulfonated oil, a long-chain alkyl acrylate polymer, an acrylate oligomer, a long-chain alkyl methacrylate polymer, a long-chain alkyl methacrylate-amine copolymer, a styrene-maleic anhydride copolymer and an olefinmaleic anhydride copolymer.

2. A recording material as claimed in claim 1, wherein said organic low molecular weight substance is selected from the group consisting of an alkanol, an alkanediol, a halogenoalkanol, a halogenoalkanediol, an alkylamine, an alkane, an alkene, an alkyne, a halogenoalkane, a halogenoalkene, a halogenoalkyne, a cycloalkane, a cycloalkene, a cycloalkyne, an unsaturated mono-carboxylic acid, an unsaturated mono-carboxylic acid ester, an unsaturated mono-carboxylic acid amide, an unsaturated mono-carboxylic acid ammonium salt, a saturated mono-carboxylic acid, a saturated mono-carboxylic acid ester, a saturated mono-carboxylic acid amide, a saturated mono-carboxylic acid ammonium salt, an unsaturated di-carboxylic acid, an unsaturated di-carboxylic acid ester, an unsaturated di-carboxylic acid amide, an unsaturated di-carboxylic acid ammonium salt, a saturated di-carboxylic acid, a saturated di-carboxylic acid ester, a saturated di-carboxylic acid amide, a saturated di-carboxylic acid ammonium salt, a saturated halogenofatty acid, a saturated halogenofatty acid ester, a saturated halogenofatty acid amide, a saturated halogenofatty acid ammonium salt, an unsaturated halogenofatty acid, an unsaturated halogenofatty acid ester, an unsaturated halogenofatty acid amide, an unsaturated halogenofatty acid ammonium salt, an allyl carboxylic acid, an allyl carboxylic acid ester, an allyl carboxylic acid amide, an allyl carboxylic acid ammonium salt, a halogenoallylcarboxylic acid, a halogenoallylcarboxylic acid ester, a halogenoallylcarboxylic acid amide, a halogenoallylcarboxylic acid ammonium salt, a thioalcohol, a thiocarboxylic acid, a thiocarboxylic acid ester, a thiocarboxylic acid amide, a thiocarboxylic acid ammonium salt and a carboxylic ester of thioalcohol.

3. A recording material as claimed in claim 1, wherein the ratio of the additive to 1 part by weight of the resin matrix is in the range of 0.005–1 part by weight.

4. A recording material as claimed in claim 3, wherein the ratio of the additive to 1 part by weight of the resin matrix is in the range of 0.01–0.3 part by weight.

5. A recording material as claimed in claim 1, wherein said organic low molecular weight substance is selected from the group of compounds (1)–(6) consisting of:

(1) a higher fatty acid having from 16–30 carbon atoms, (2) a higher fatty acid having from 10–15 carbon atoms, (3) a higher alcohol having from 12–24 carbon atoms, (4) a compound represented by the general formula:

$$R_1\text{-}X\text{-}R_2,$$

wherein $R_1$ and $R_2$ each represents a substituted or unsubstituted alkyl group or aralkyl group having from 10–30 carbon atoms; or represents $—R_3\text{-}COOR_4$ or $—R_5OCOR_6$, $R_3$ and $R_5$ each being an alkylene group having from 1–30 carbon atoms and $R_4$ and $R_6$ each being a substituted or unsubstituted alkyl group or aralkyl group having from 10–30 carbon atoms, and X represents —O—, —NH—, —S— or —S—S— group, (5) a compound represented by the general formula:

$$R_{11}—COOR_{12},$$

wherein $R_{11}$ represents an alkyl group having from 10–30 carbon atoms, and $R_{12}$ represents an alkyl group having from 1–30 carbon atoms, and (6) a compound represented by the general formula:

$$C(CH_2OR_{20})_4,$$

wherein $R_{20}$ represents a hydrogen atom or $—COR_{21}$, $R_{21}$ being an alkyl group having from 10–30 carbon atoms.

6. A recording material as claimed in claim 5, wherein said organic low molecular weight substance is compound (1).

7. A recording material as claimed in claim 6, wherein compound (1), the higher fatty acid, has from 16–24 carbon atoms.

8. A recording material as claimed in claim 1, wherein the resin matrix is selected from the group consisting of polyvinyl chloride, vinyl chloride-vinyl acetate copolymer, vinyl chloride-vinyl acetate-vinyl alcohol copolymer, vinyl chloride-vinyl acetate-maleic acid copolymer, vinyl chloride-acrylate copolymer, polyvinylidene chloride, vinylidene chloride-vinyl chloride copolymer, vinylidene chloride-acrylonitrile copolymer, polyester, polyamide, polyacrylate, polymethacrylate, acrylate-methacrylate copolymer and silicone resin.

9. A recording material as claimed in claim 1, wherein the weight ratio of the organic low molecular weight substance to the resin matrix is from about 2:1–1:16.

10. A recording material as claimed in claim 9, wherein the weight ratio of the organic low molecular weight substance to the resin matrix is from 2:1–1:5.

11. A recording material as claimed in claim 10, wherein the weight ratio of the organic low molecular substance to the resin matrix is 2:1–1:2.5.

* * * * *